United States Patent [19]

Crute et al.

[11] 4,136,795

[45] Jan. 30, 1979

[54] PLASTIC RADIATOR CAP

[75] Inventors: Billy G. Crute; Henry Ruhl, both of Connersville; William R. Coffey, Indianapolis, all of Ind.

[73] Assignee: Stant Manufacturing Company, Inc., Connersville, Ind.

[21] Appl. No.: 610,652

[22] Filed: Sep. 5, 1975

[51] Int. Cl.[2] ..... B65D 51/16

[52] U.S. Cl. ..... 220/203; 220/303; 220/DIG. 32

[58] Field of Search ..... 220/203, 303, 301, 306, 220/319, 320, 256, DIG. 32; 215/217, 258, 219, 220; 206/403–406; 70/165

[56] References Cited

U.S. PATENT DOCUMENTS

| | | | |
|---|---|---|---|
| 1,276,768 | 8/1918 | Hoyle et al. | 220/256 |
| 2,521,201 | 9/1950 | Clark et al. | 220/203 |
| 2,649,986 | 8/1953 | Konchan | 220/203 |
| 2,908,417 | 10/1959 | Conner et al. | 220/256 |
| 3,027,035 | 3/1962 | Farago | 215/219 |
| 3,053,408 | 9/1962 | Rodgers | 270/203 |
| 3,080,994 | 3/1963 | Chausson | 220/203 |
| 3,086,677 | 4/1963 | Konchan | 220/203 |
| 3,102,659 | 9/1963 | Bowden | 220/301 |
| 3,164,288 | 1/1965 | Boomgaard | 220/203 |
| 3,297,153 | 1/1967 | Fattori | 206/403 |
| 3,468,444 | 9/1969 | Martin, Jr. | 215/19 |
| 3,809,272 | 5/1974 | Maki | 215/219 |
| 3,881,507 | 5/1975 | Stump | 137/493.4 |

FOREIGN PATENT DOCUMENTS

| | | | |
|---|---|---|---|
| 1244916 | 9/1960 | France | 220/366 |
| 1285298 | 1/1962 | France | 220/203 |
| 1106650 | 6/1965 | France | 220/203 |
| 1410365 | 8/1965 | France | 220/203 |
| 874693 | 10/1961 | United Kingdom | 220/307 |
| 1015674 | 1/1966 | United Kingdom | 220/203 |
| 1050080 | 12/1966 | United Kingdom | 220/203 |
| 1107729 | 3/1968 | United Kingdom | 220/203 |
| 1237176 | 6/1971 | United Kingdom | 220/203 |

*Primary Examiner*—William Price
*Assistant Examiner*—Allan N. Shoap
*Attorney, Agent, or Firm*—Jenkins, Coffey & Hyland

[57] ABSTRACT

A cap for a radiator filler neck of the type having a peripherally extending upper lip and, downwardly from the lip, a radially inwardly and peripherally extending, upwardly facing pressure valve seat concentric with the axes defined by the neck and the cap. The cap comprises an outer shell for engaging and closing the filler neck, a molded plastic retainer connected to the outer shell, and a molded plastic pressure valve member for engaging the valve seat. The retainer has a peripherally and radially outwardly extending flange and a downwardly extending shank, a sealing ring is carried by the flange for engaging and sealing against the upper lip, and the valve member is provided with an upwardly extending shank. The shanks have interlocking portions for connecting the valve member to the retainer and a spring is disposed about the shanks for yieldably urging the valve member against the valve seat as well as to maintain the interlocking portions in engagement. The interlocking shank portions form a bayonet-type connecting arrangement in which one of the two shanks is moved axially into the other shank and then rotated and then moved axially in the opposite direction to complete the interlocking engagement. The retainer is provided with a plurality of peripherally spaced apart, downwardly and radially outwardly extending fingers which deflect resiliently inwardly to permit the retainer to be inserted into the shell and which then move radially outwardly to secure the retainer within the shell.

10 Claims, 5 Drawing Figures

Fig. 3
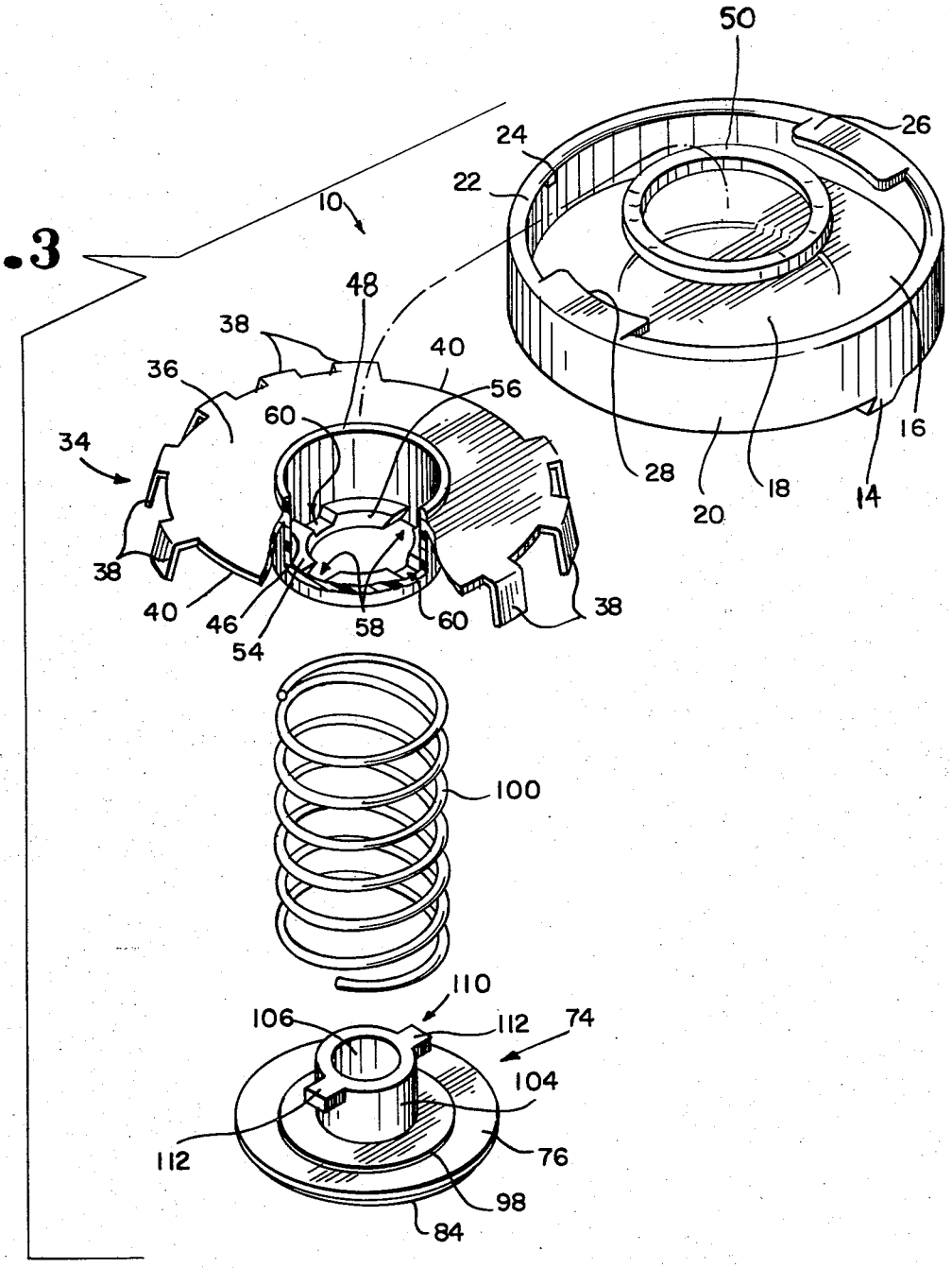
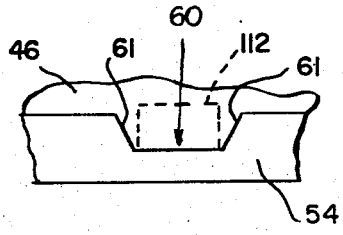
Fig. 4
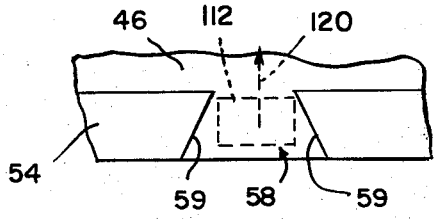
Fig. 5

PLASTIC RADIATOR CAP

The present invention relates to radiator caps and more particularly to the provision of a molded plastic radiator cap comprising a molded plastic outer shell, a molded plastic retainer, and a molded plastic pressure valve member formed to provide an interlocking connection with the retainer.

There are several suggestions of molded plastic cap assemblies for filler necks of radiators in the prior art. One example of the prior art is the U.S. Pat. No. 3,164,288 to Boomgaard issued Jan. 5, 1965 and disclosing a cap including a molded plastic outer shell and a pressure valve member which are snapped together or interengaged by distortion of portions of the shell and valve member. A more recent U.S. Pat. No. 3,881,507 issued to Eugene Stump May 6, 1975 discloses a snap connection between the pressure valve member and outer shell. Another example of the prior art is shown in the Chausson U.S. Pat. No. 3,080,994 issued Mar. 12, 1963 and showing the pressure valve integrally formed on the outer shell, i.e., resiliently movable relative to the outer shell. Still another example of a prior art plastic radiator cap is disclosed in a French Pat. No. 1.406.650. Still another example of a prior art plastic radiator cap is disclosed in French Pat. No. 1.285.298. These two French patents disclose a cap structure in which the pressure valve member is connected to the outer shell member by distortion of the plastic part (French Pat. No. 1.285.298) and by providing a laterally opening socket on the pressure valve member for receiving a stem on the shell member (French Pat. No. 1.406.650).

The present invention is believed to be a significant improvement over such prior art plastic radiator caps because of the manner in which the pressure valve member is interlocked with the retainer as well as the manner in which the retainer is connected within the outer shell. The shell has a depending skirt formed to provide a peripherally and radially inwardly extending flange means. The retainer has a flange provided with a plurality of peripherally spaced apart, downwardly and radially outwardly extending fingers for engaging the flange means to connect the retainer within the shell, the fingers being resiliently deflectable radially inwardly to move upwardly past the flange means when the retainer is inserted into the shell. The pressure valve member and the retainer are connected together by interlocking shank portions proportioned and designed to provide a bayonet-type connecting arrangement in which one shank portion moves into the other shank portion, rotates about their common axes, and then moves in the opposite direction to provided the interlocking connection. The pressure valve spring is effective to maintain the interlocking connection.

Other features of the present invention will become apparent as this description progresses.

In the drawings:

FIG. 3 is an exploded perspective view of the cap of the present invention with the retainer partially cut away in sections for clarity; and FIGS. 4 and 5 are enlarged, fragmentary sectional views of a portion of the bayonet-type connecting arrangement.

Figure 1:
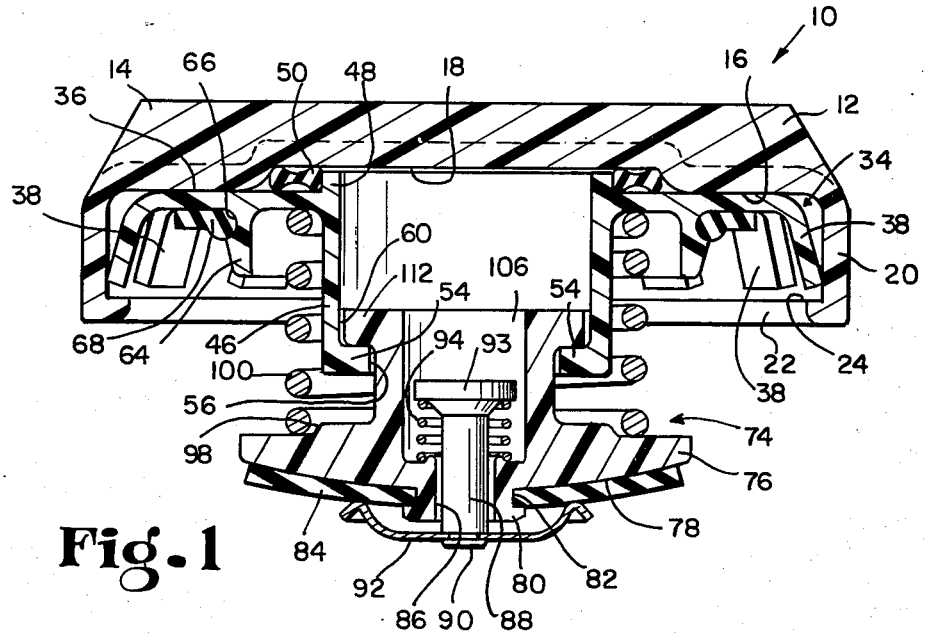
FIG. 1 is a sectional view of the cap of the present invention.
Figure 2:
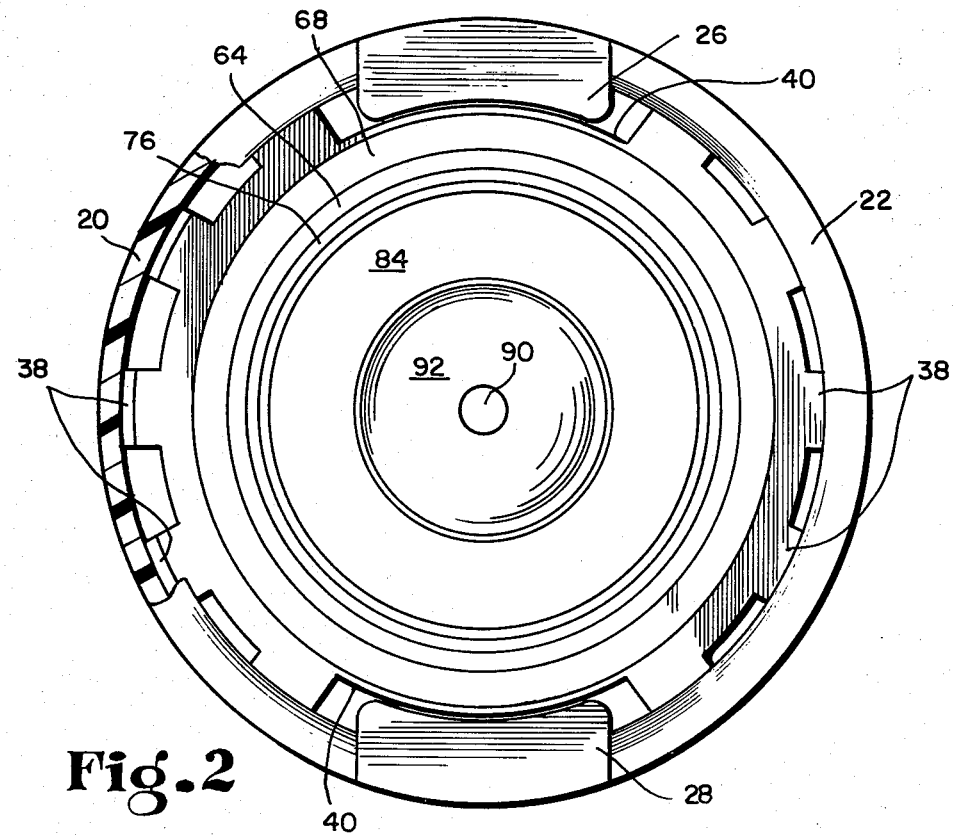
FIG. 2 is a bottom view, partially sectioned, of the cap of the present invention.

Referring now particularly to the drawings, it will be seen that the illustrative cap 10 comprises a molded plastic outer shell 12 formed to have a generally flat top with a ridge 14 extending transaxially across its upper surface to provide a hand grip and with an outer, annular flat bottom surface 16 surrounding a circular depression defining a circular bottom surface 18. A peripherally extending skirt 20 depends from the top of the cap to provide, at its lower extremity, radially inwardly and peripherally extending flange means 22 defining an axially upwardly facing flange surface 24. Diametrically oppositely disposed portions 26,28 of this flange 22 extend further radially inwardly to provide rigid ears for engaging the conventional cam-lock surface extending peripherally and axially about radiator filler necks. Such conventional radiator filler necks are shown in the prior art mentioned hereinabove.

The cap 10 also comprises a molded plastic retainer 34 connected to the outer shell 12, the illustrative retainer being formed to provide, at its upper extent, a peripherally and radially outwardly extending flange 36 having, at its outer periphery, a plurality of peripherally spaced apart, downwardly and radially outwardly extending fingers 38 for engaging the upper surface 24 of the flange means to connect the retainer within the shell 12. The fingers 38 are preferably resiliently deflectable radially inwardly to move upwardly past the flange means 22 when the retainer is inserted into the shell. After the fingers 38 move past the flange means 22, they move radially outwardly to their normal positions. Once this occurs, the connection between the shell 12 and the retainer 34 is secured to the point that they cannot be disconnected without breaking one or more of the fingers 38 or portions of the shell. Illustratively, there are two sets of five such fingers 38 spaced apart to provide openings 40 for the ears 26,28. Once the connection is made between the shell 12 and retainer 34, the retainer is rotatable within the shell or, conversely, the shell is rotatable relative to the retainer so that the shell can be twisted onto and removed from the filler neck while the retainer stays relatively stationary on the filler neck. Once the ears 26,28 are disconnected from the cam-lock surface of the filler neck, the cap 10 can be raised vertically upwardly. It is known that such cam-lock surfaces conventionally have pressure-relieving positions for the ears 26,28 such that the outer shell 12 can be backed off to these positions to relieve the pressure through the filler neck drain tube. After that pressure is relieved, the shell can be rotated further to the disconnecting position on the filler neck to remove the cap 10.

The retainer 34 is also integrally molded to provide a depending shank 46 which is in the form a cylindrical shell, a portion of this shell or shank extending upwardly as indicated at 48 above the upper surface of the flange 36 and into the depression 18 in the bottom surface of the shell 12. A rubber-like sealing ring 50 is disposed about this upwardly projecting portion 48 to provide means for sealing the retainer 34 to the shell 12 which, of course, has a closed top.

The lower portion of the shank 46 is formed to provide peripherally and radially inwardly extending locking flange means or a locking flange 54, the internal diameter of which is indicated at 56. This locking flange 54 serves as an abutment or abutment surface for the bayonet-type connecting arrangement of the present invention in that, illustratively, it is provided with a pair of diametrically opposed entry openings or entry notches 58 extending axially therethrough and a pair of diametrically opposed, upwardly opening sockets or notches 60. The sockets 60 are peripherally removed 90° from the entry openings 58. Each socket 60 has peripherally spaced apart side walls 61 (FIG. 4) inclining upwardly and peripherally outwardly while each entry opening 58 has peripherally spaced apart side walls 59 (FIG. 5) inclining downwardly and peripherally outwardly. The manner in which these entry openings 58 and sockets 60 are used will be discussed hereinafter.

The retainer 34 is also molded to provide, an annular depending flange 64 spaced radially outwardly from the shank 46 and formed with a peripherally extending, outwardly opening groove 66 adjacent the flange 36. A rubberlike sealing gasket is secured in this groove 66 to be against the flange 36 to provide means for sealing against the upper lip of the radiator filler neck. Flange 64 extends downwardly into the filler neck a short distance. The relative rotation between the shell 12 and the retainer 34 permits the shell to be rotated to connect and disconnect the cap from the filler neck without scrubbing the sealing gasket 68 against the upper lip of the filler neck. When the cap is connected on the filler neck, the gasket 50 and the gasket 68 completely and tightly seal the upper lip of the filler neck.

Finally, the cap 10 comprises a pressure valve member 74 which engages and closes the conventionally provided peripherally extending, upwardly facing pressure valve seat which is concentric with the axes defined by the filler neck and the cap and which is spaced below the upper lip. Conventionally, between the upper lip and the pressure valve seat, the filler neck is provided with an exhaust opening to which a rubber tube is connected. The pressure valve member 74 is a molded plastic pressure valve member molded to provide a peripherally and radially outwardly extending flange 76 defining a bottom surface which is slightly convex as indicated at 78. A portion 80 of this valve member extends concentrically downwardly and is formed to provide an outwardly opening, peripherally extending groove 82 into which the internal diameter of a rubberlike sealing gasket 84 is inserted. This gasket 84 bears against the pressure valve seat in the filler neck. The valve member 74 is also formed to provide a concentric, axially extending opening 86 which serves as a vacuum vent valve opening and illustratively through which extends a valve stem 88. The lower end of the valve stem 88 is formed over as indicated at 90 to capture thereon a vacuum valve flange 92. The upper end of the stem 88 is enlarged as indicated at 93 to capture a vacuum valve spring 94 between the stem 88 and the pressure valve member as illustrated. This spring 94 urges the vacuum valve 92 upwardly against the gasket 84 to provide a normally closed vacuum valve.

The valve member 74 flange 76 is formed with a concentric spring boss 98 as a retainer for the pressure valve compression spring 100 which acts between the retainer 34 and the pressure valve member 74 yieldably to urge the pressure valve member against the valve seat and the filler neck.

The valve member 74 is also formed to provide an upwardly extending shank 104 which is in the form of a cylindrical shell providing an axially extending opening 106, in communication with the vent valve opening 86. This shank 104 is also provided with locking flange means at its upper extent which, in the illustrative embodiment, takes the form of a pair of diametrically oppositely disposed, radially outwardly extending protrusions or lugs 112 which are proportioned and designed to move axially upwardly through the entry openings 58, then to be rotated 90° and lowered into engagement with the upwardly opening sockets 60. The compression spring 100, of course, yieldably urges the lugs 112 into engagement with the sockets 60 to maintain the shanks 104 and 46 in interlocking engagement to connect the pressure valve member 74 to the retainer 34. While radially extending lugs 112 are shown on the shank 104, it will be appreciated that the illustrated arrangement may be reversed in that the lugs could be provided on the shank 46 and a flange similar to the flange 54 may be provided on the shank 104. The arrow 120, therefore, showing the lug 112 moving upwardly through the entry opening 58 in FIG. 5 is merely illustrative. The main objective of the type of connection illustrated is to provide a strong and secure connection which will permit the pressure valve member 74 to move under pressure relative to the retainer 34 to vent the radiator under abnormal pressure conditions. This type of connection has considerable advantage over a distortion snap-together connection which requires precision molding of the parts so that they will fit after being snapped together and which of course, requires resilient portions for the distortion to occur. The connection of the present invention can be established with extremely rigid plastic parts or portions of plastic parts. For instance, the shell 12, retainer 34 and pressure valve members 74 may be molded from acetal resin or any other material, including glass or fiber filled material, which is extremely tough and durable and which will stand the extremely high temperatures, pressures, and action of the heated radiator hood. For instance, the retainer 34 and pressure valve member 74 may be molded from 12 percent glass filled acetal resin while the shell 12 may be molded from 6 percent glass filled acetal resin.

When the cap 12 is assembled on a conventional filler neck, the radiator is vented for excessive pressures by lifting the pressure valve member 74 upwardly relative to the filler neck valve seat. When an excessive vacuum condition exists in a radiator, the vacuum valve 92 lowers to permit fluid to flow from the filler neck through the entry opening 58 and then downwardly through the openings 106 and 86 past the vacuum valve member.

We claim:

1. For a radiator filler neck of the type having a peripherally extending upper lip and, downwardly from said lip, a radially inwardly and peripherally extending, upwardly facing pressure valve seat, a cap comprising an outer shell for engaging and closing said filler neck, a molded plastic retainer connected to said outer shell, and a molded plastic pressure valve member for engaging said seat, said retainer having a peripherally and radially outwardly extending flange and a downwardly extending shank, sealing means carried by said flange for engaging and sealing against said upper lip, said valve member providing an upwardly extending shank, said shanks having interlocking portions for connecting said valve member to said retainer, spring means for yieldably urging said valve member against said valve seat, said spring means acting between said retainer and valve member to hold said interlocking shank portions in engagement, the improvement in which said shell has a peripherally depending skirt formed to provide peripherally and radially inwardly extending flange means having an upwardly facing surface, said retainer flange having a plurality of peripherally spaced apart, downwardly and radially outwardly extending fingers for engaging said upwardly facing surface of said flange means to connect said retainer within said shell, said fingers being resiliently deflectable radially inwardly to move upwardly past said flange means when said retainer is inserted into said shell, said retainer being rotatable in said shell.

2. The improvement of claim 1 in which said outer shell has a closed top from which said skirt depends, and sealing means disposed between said retainer and said closed top.

3. For a radiator filler neck of the type having a peripherally extending upper lip and, downwardly from said lip, a radially inwardly and peripherally extending, upwardly facing pressure valve seat, a cap comprising an outer shell for engaging and closing said filler neck, a molded plastic retainer connected to said outer shell, and a molded plastic pressure valve member for engaging said seat, said retainer having a peripherally and radially outwardly extending flange and a downwardly extending shank, sealing means carried by said flange for engaging and sealing against said upper lip, said valve member providing an upwardly extending shank, said shanks having interlocking portions for connecting said valve member to said retainer, spring means for yieldably urging said valve member against said valve seat, said spring means acting between said retainer and valve member to hold said interlocking shank portions in engagement, the improvement in which said interlocking shank portions include a radially directed abutment formed on said retainer shank, said radially directed abutment having a pair of entry openings diametrically opposed and extending axially therethrough and a pair of sockets diametrically opposed and peripherally spaced from said entry openings, said valve member shank being formed to have a pair of lugs diametrically opposed and movable axially through said entry openings and then about said cap axis to engage said sockets and said retainer shank is formed as a downwardly extending cylindrical shell having, at its distal end, radially inwardly extending flange means defining said abutment, said lugs extending radially outwardly from said valve member shank, each said socket being upwardly opening and having peripherally spaced apart side walls inclining upwardly and peripherally outwardly, each said entry opening having peripherally spaced apart side walls inclining downwardly and peripherally outwardly.

4. The improvement of claim 3 in which said cylindrical shell projects upwardly above said retainer flange, said outer shell having a closed top from which said skirt depends, and sealing ring means disposed between said retainer and said closed top and about said cylindrical shell.

5. For a radiator filler neck of the type having a peripherally extending upper lip and, downwardly from said lip, a radially inwardly and peripherally extending, upwardly facing pressure valve seat concentric with the axis of said filler neck, a cap comprising an outer shell for engaging and closing said filler neck, a molded plastic retainer connected to said outer shell, and a molded plastic pressure valve member for engaging said seat, said retainer having a peripherally and radially outwardly extending flange and a downwardly extending shank, sealing means carried by said flange for engaging said upper lip, said valve member providing an upwardly extending shank, said shanks having interlocking portions for connecting said valve member to said retainer, spring means for yieldably urging said valve member against said valve seat, said spring means acting between said retainer and valve member, the improvement in which said outer shell has a depending skirt formed to provide peripherally and radially inwardly extending flange means having an upwardly facing surface, said retainer flange having a plurality of peripherally spaced apart, downwardly and outwardly extending fingers integrally molded thereon and resiliently deflectable inwardly to move upwardly past said flange means then to move outwardly to engage said upwardly facing surface permanently to secure said retainer into said shell, said retainer being rotatable in said shell.

6. The improvement of claim 5 in which one of said interlocking shank portions has a radially directed flange having diametrically opposed entry openings extending axially therethrough and diametrically opposed sockets therein peripherally removed from said entry openings, and the other of said interlocking shank portions has diametrically opposed radially directed lugs movable axially through said entry openings and then about said cap axis to engage said sockets, said spring means being effective to hold said lugs into engagement with said sockets.

7. The improvements of claim 5 in which said sockets are upwardly opening such that said lugs are urged by said spring means downwardly into engagement with said sockets, each said socket having peripherally spaced apart side walls inclining upwardly and peripherally outwardly, each said entry opening having peripherally spaced apart side walls inclining downwardly and peripherally outwardly.

8. The improvement of claim 7 in which said retainer shank is formed as a downwardly extending cylindrical shell providing, at its distal end, said flange directed radially inwardly, said lugs extending radially outwardly from said valve member shank.

9. The improvement of claim 5 in which said outer shell has a closed top from which said skirt depends, and means for providing a seal between said retainer and said closed top.

10. A radiator cap comprising an outer shell having a generally flat circular upper portion having top and bottom sides and a depending skirt portion terminating in a radially inwardly extending flange defining an opening into said shell, a pressure valve member, a molded plastic retainer for said valve member, said retainer having a generally flat circular upper portion with depending means connected to said valve member, said flat circular upper portion of said retainer further having a plurality of resiliently mounted, integrally molded, peripherally spaced apart projecting members depending therefrom, said members resiliently deflecting inwardly toward the axis of said retainer for passage through said opening into said shell and resiliently urging outwardly against said depending skirt for holding said retainer permanently between said bottom side of said upper portion of said shell and said flange thereof, said retainer being rotatable in said shell.

* * * * *